US008651458B2

(12) United States Patent
Liao

(10) Patent No.: US 8,651,458 B2
(45) Date of Patent: Feb. 18, 2014

(54) HAND-OPERATING VACUUM PULLING DEVICE

(75) Inventor: Po-Lin Liao, Taichung (TW)

(73) Assignee: Lih Yann Industrial Co., Ltd., Taichung (TW)

( * ) Notice: Subject to any disclaimer, the term of this patent is extended or adjusted under 35 U.S.C. 154(b) by 278 days.

(21) Appl. No.: 13/206,860

(22) Filed: Aug. 10, 2011

(65) Prior Publication Data

US 2013/0037766 A1 Feb. 14, 2013

(30) Foreign Application Priority Data

Nov. 9, 2010 (TW) ..... 99221665 U

(51) Int. Cl.
*B66F 3/00* (2006.01)
*B21J 13/08* (2006.01)

(52) U.S. Cl.
USPC ..... 254/133 R; 72/457

(58) Field of Classification Search
USPC ..... 254/133 R, 21, 25; 269/21; 72/457; 294/64.1; 29/269–280
See application file for complete search history.

(56) References Cited

U.S. PATENT DOCUMENTS 4,753,104 A * 6/1988 Strozier ..... 72/457

* cited by examiner

*Primary Examiner* — Lee D Wilson
*Assistant Examiner* — Nirvana Deonauth
(74) *Attorney, Agent, or Firm* — Muncy, Geissler, Olds & Lowe, PLLC

(57) ABSTRACT

A hand-operated vacuum pulling device includes a shank, over which a backward ram is slidable fit. The shank has a front end to which a suction cup is attached and a rear end to which a handgrip defining a cylinder and having a pressure relief seat is attached. The pressure relief seat forms a ram stop at a joint thereof with the shank. The handgrip has a rear end to which a ring-shaped cover assembly is attached. The piston assembly is manually operable to induce a vacuum inside the cylinder. And then, the ring-shaped cover assembly can be manually operated to pull the piston assembly backward for repeated operation of the piston assembly to thereby make a spring contained in the piston assembly stiffer and increase the suction power of the suction cup. The backward ram can be quickly moved backward to impact the ram stop for improving pulling effect.

3 Claims, 6 Drawing Sheets

HAND-OPERATING VACUUM PULLING DEVICE

BACKGROUND OF THE INVENTION

1. Field of the Invention

The present invention relates to the field of vacuum pulling device, and in particular to a hand-operated vacuum pulling device, which does not need to operate with an air compressor and still provides a powerful suction force for enhanced pulling effect with hand operations.

2. The Related Arts

With reference to FIG. 1, a conventional car dent puller is shown. The dent puller is used to repair a dent of metal sheet of car body and may also be used to move or remove for example a car windshield glass, a timber, or a tile. The conventional puller is operated in a pneumatic manner and such a pneumatic puller has an air inlet 4 that must be connected through a hose 5 to air compressor 1, in order to induce vacuum in a suction cup 2 at a front end of the puller for holding an article with a suction force induced by the vacuum. A backward ram 3 is then operated to induce impact force for loosening and pulling off the article.

The conventional pneumatic puller suffers certain drawbacks:

(1) The conventional pneumatic puller requires connection with an air compressor 1 in order to generate a suction force. The air compressor 1 is often operated with an external supply of electrical power so that it must be installed at a fixed sit. Due to the limitation of installation at a fixed site, the conventional pneumatic puller is generally not portable for being free to use at any desired location and under any condition.

(2) The conventional pneumatic puller cannot be operated independently and this certainly affects the market acceptability of this product, for to carry out a simple pulling operation, besides the puller itself, an air compressor 1 must be arranged. This is generally not an available option for general consumers.

Thus, in view of the above discussed drawbacks, for the industry, as well as being desired by the general consumers, a pulling device that is more practical is strongly needed and this is a goal and direction for developments to be made in this field.

The present invention aims to provide a hand-operated vacuum pulling device that overcomes the above discussed problems.

SUMMARY OF THE INVENTION

The technical problem to be solved here is that the conventional pneumatic pulling device must be operated with vacuum generated by an air compressor and the air compressor is operated with an external supply of electrical power, which makes the use constrained to a specific site, so that the conventional pneumatic pulling device is limited to a specific site for the use thereof and is not allowed to be freely moved and used at any desired location and under any condition.

The technical solution that the present invention adopts to solve the problem is a hand-operated vacuum pulling device, which comprises an elongate shank, over which a backward ram is slidably fit. The elongate shank has a front end to which a suction cup is attached and a rear end to which a handgrip that comprises a pressure relief seat is attached. The pressure relief seat forms a ram stop section at a joint thereof with the shank. The handgrip has a rear end to which a ring-shaped cover assembly is attached. The piston assembly is manually operable to induce a vacuum inside the cylinder. And then, the ring-shaped cover assembly can be manually operated to pull the piston assembly backward for repeated operation of the piston assembly to thereby make a spring contained in the piston assembly stiffer and increase the suction power of the suction cup. The backward ram can be quickly moved backward to impact the ram stop for improving pulling effect.

For the known vacuum puller device, it requires an air compressor and the air compressor consumer electrical power. This makes the known device inoperable in a wild location or at a site where electrical power is not readily available. In addition, installation cost of an air compressor is quite high and is not affordable for general consumers. On the other hand, the present invention provides a hand-operated vacuum pulling device that is a stand-alone device that can be operated immediately after purchasing and requiring no air compressor, but providing substantially the same suction power as the conventional pneumatic puller device.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

The present invention provides a hand-operated vacuum pulling device. To provide a better understanding of the feature and structure of the present invention, an illustrative example will be given as an embodiment that practices the present invention.

Figure 1:
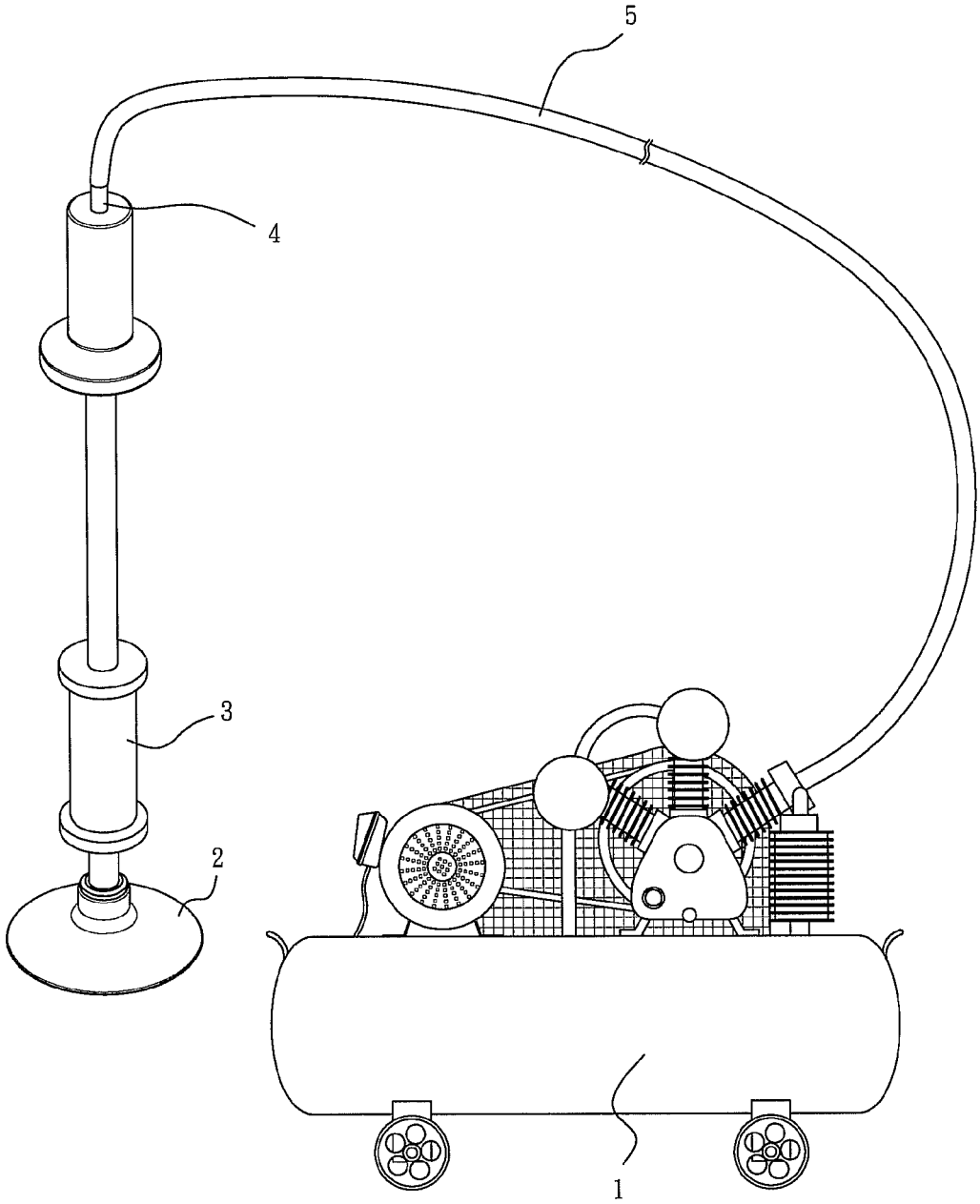
Fig 1 Prior Art
FIG. 1 is a schematic view illustrating a conventional pneumatic puller.
Figure 2:
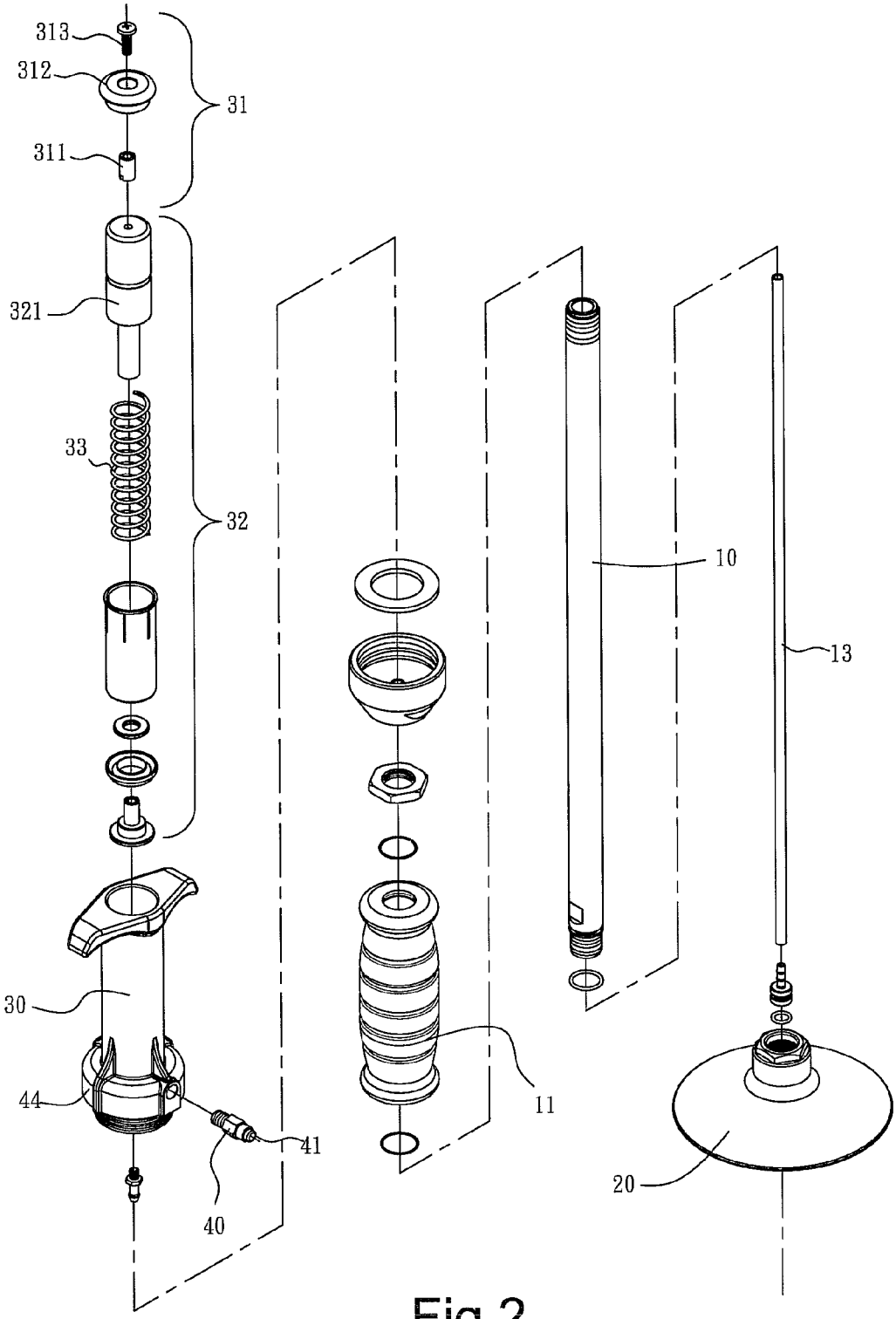
FIG. 2 is an exploded view of a hand-operated vacuum pulling device according to an embodiment of the present invention.
Figure 3:
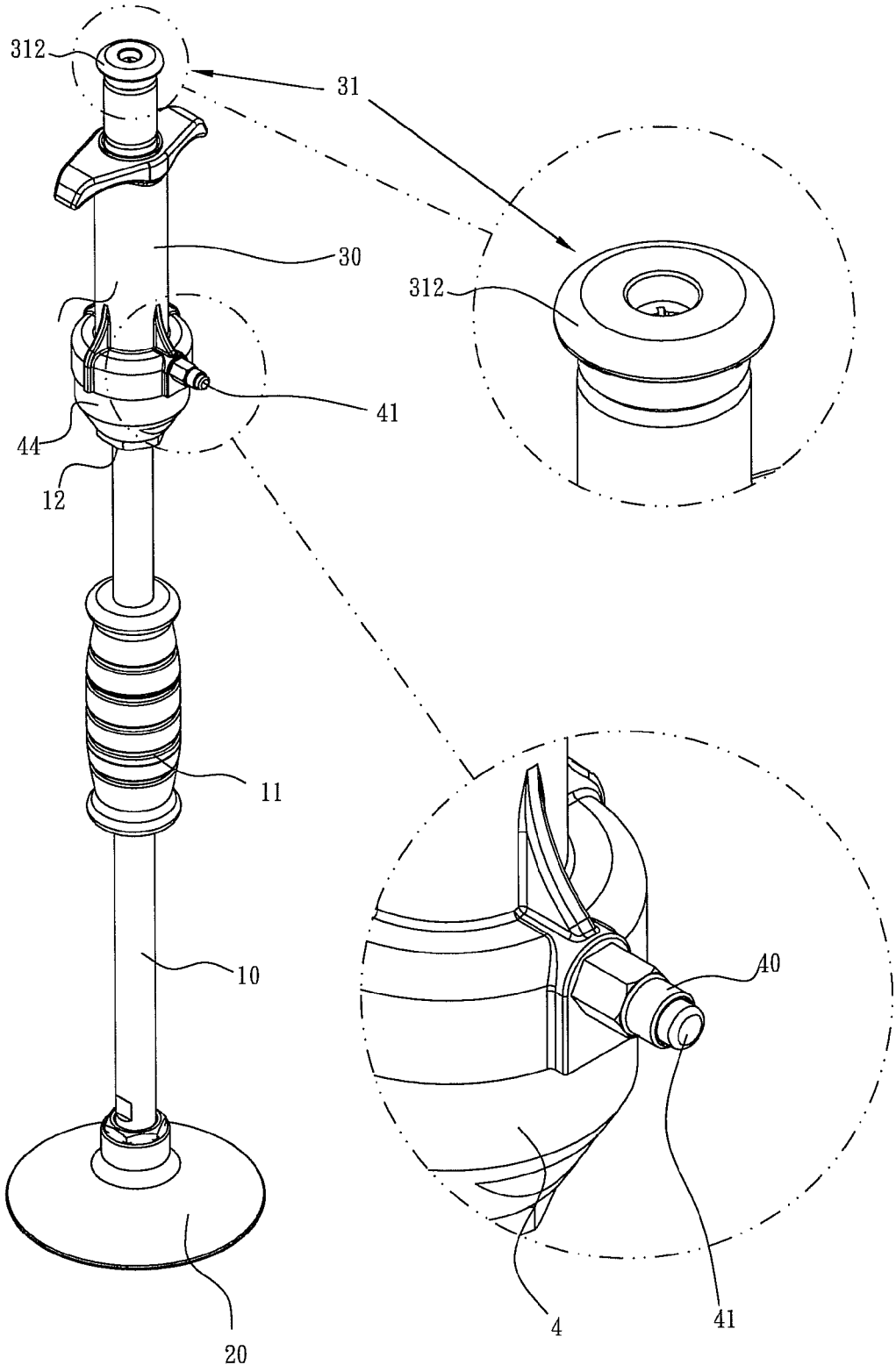
FIG. 3 is a perspective view of the hand-operated vacuum pulling device of the present invention.

Reference is now made to the drawings and in particular to FIGS. 2 and 3, which respectively show an exploded view and a perspective view of the hand-operated vacuum pulling device according to the present invention. The hand-operated vacuum pulling device of the present invention comprises an elongate shank 10 has a front end and a rear end and an outer circumferential surface axially extending between the front end and the rear end. A backward ram 11 forms a central bore slidably fit over the outer circumference of the elongate shank 10 to be axially movable with respect to the shank 10. A suction cup 20 is attached to the front end of the elongate shank 10.

A hand-operated pump assembly comprises a handgrip 30, which serves as a cylinder of the pump, having a front end forming a pressure relief seat 4 that is in communication with the cylinder. A piston assembly 32 is movably received in an interior space of the pump cylinder. The handgrip 30 is attached to the rear end of the elongate shank 10 by the pressure relief seat 40. A tube 13 is received in and extends through the elongate shank 10 to connect between and in communication with the pump handgrip 30 and the suction cup 20. The pressure relief seat 4 forms a ram stop section 12 at a front end thereof where the seat joints the shank. The pump handgrip 30 has a free rear end to which a ring-shaped cover assembly 31 is attached. The piston assembly 32 can be depressed down (in a direction toward the shank) to expel air out of the pump cylinder thereby inducing a negative pressure or vacuum inside the pump cylinder. The ring-shaped cover assembly 31 is helpful for a user to pull the piston assembly 32 backward (in a direction away from the shank). This air expulsion operation is preferably repeated several times, so that an even lower pressure or increased vacuum degree is induced inside the pump cylinder. The vacuum induced inside the pump cylinder is counteracted by the spring force of the spring 33 that is supported between the ring-shape cover assembly 31 and an internal stop mounted inside the pump cylinder. Successive performance of the air expulsion operations makes the spring 33 getting shorter and stiffer, as well as increasing the vacuum suction force of the suction cup 20. The backward ram 11 may then be fast moved in the backward direction to cause a backward impact against the ram stop section 12 and this generates a pulling effect on an article to which the suction cup is attached.

The ring-shaped cover assembly 31 comprises a mounting sleeve 311, a ring member 312, and a locking member 313. The mounting sleeve 311 is fit into and fixed in a central bore of a depression stem 321 of the piston assembly 32. The ring member 312 is positioned on the depression stem 321 of the piston assembly 32 and then the locking member 313 secures the ring member 312 to the mounting sleeve 311 that is retained in the depression stem 321. The ring member 312 of the ring-shaped cover assembly 31 is provided for being held by a user's hand in order to pull backward the piston assembly 32 when the piston assembly 32 is over-drawn into the handgrip, so as to facilitate repeated operations of manually pulling and pushing the piston assembly 32.

The pressure relief seat 4 has a side wall in which a pressure relief valve 40 (also see FIG. 3) is mounted. The pressure relief valve 40 comprises a relief button 41, which, once depressed, causes an elastic element 42 (FIG. 4) to push away a plug 43, thereby releasing the vacuum and allowing air to flow from the relief button 41 through the tube 13 to enter the suction cup 20 and thus removing the suction force induced in the suction cup 20.

Figure 4:
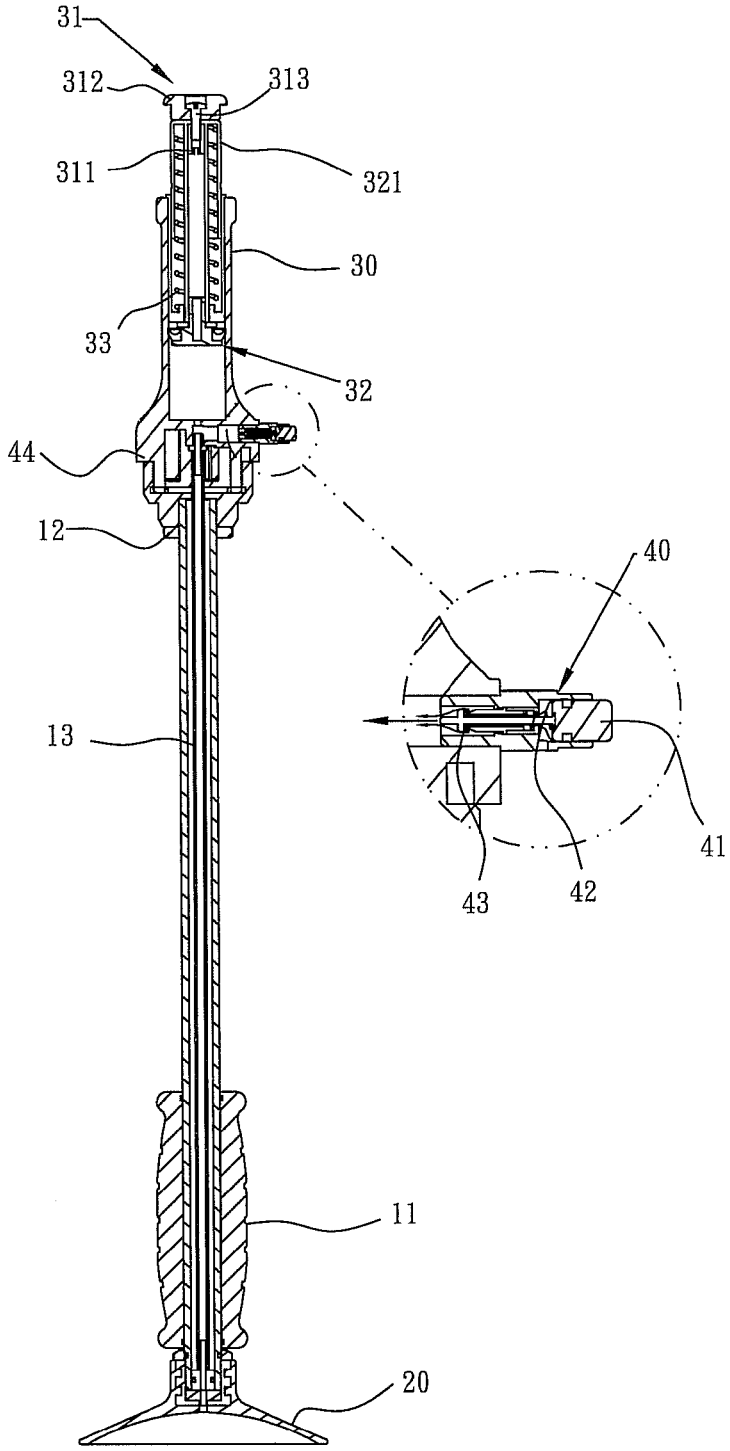
FIG. 4 is a cross-sectional view of the hand-operated vacuum pulling device according to the present invention.
Figure 5:
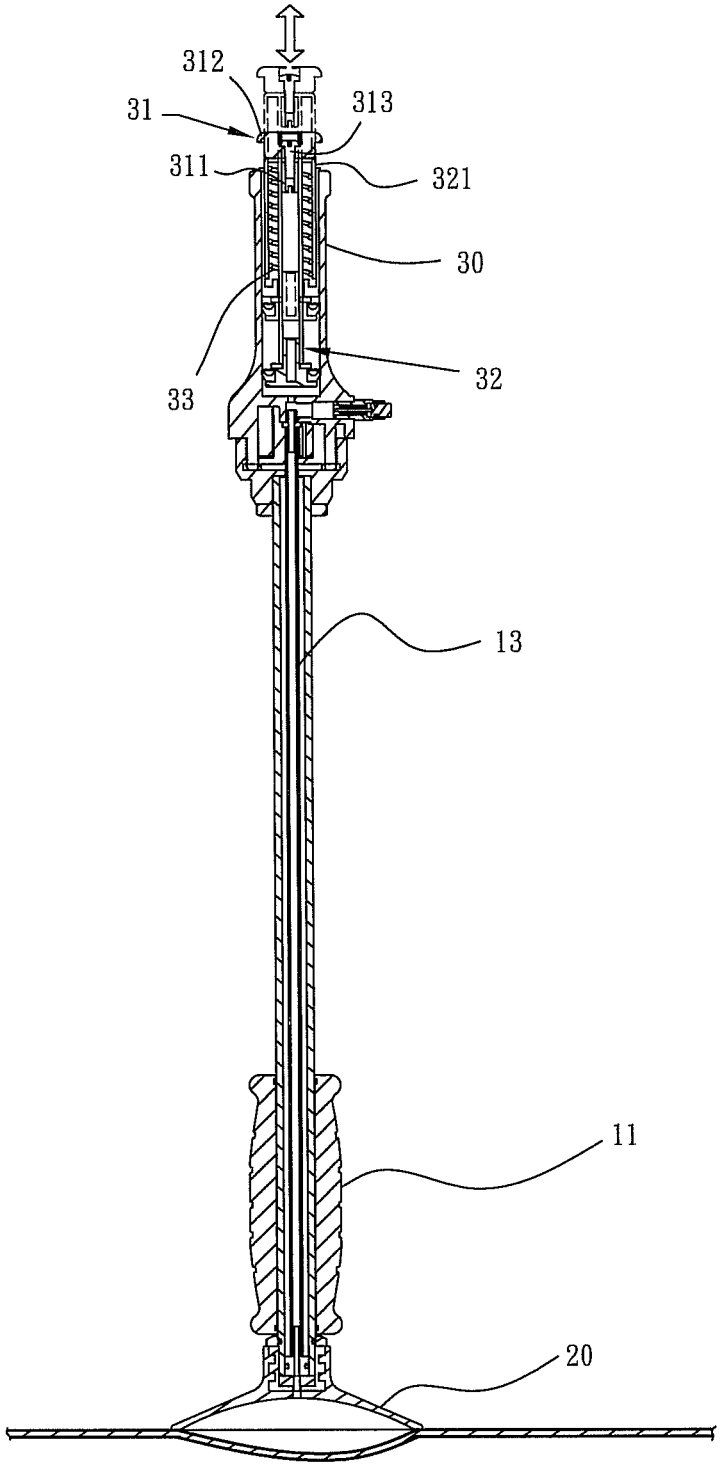
FIG. 5 is a cross-sectional view illustrating operation of the hand-operated vacuum pulling device with a ring-shaped cover assembly thereof.
Figure 6:
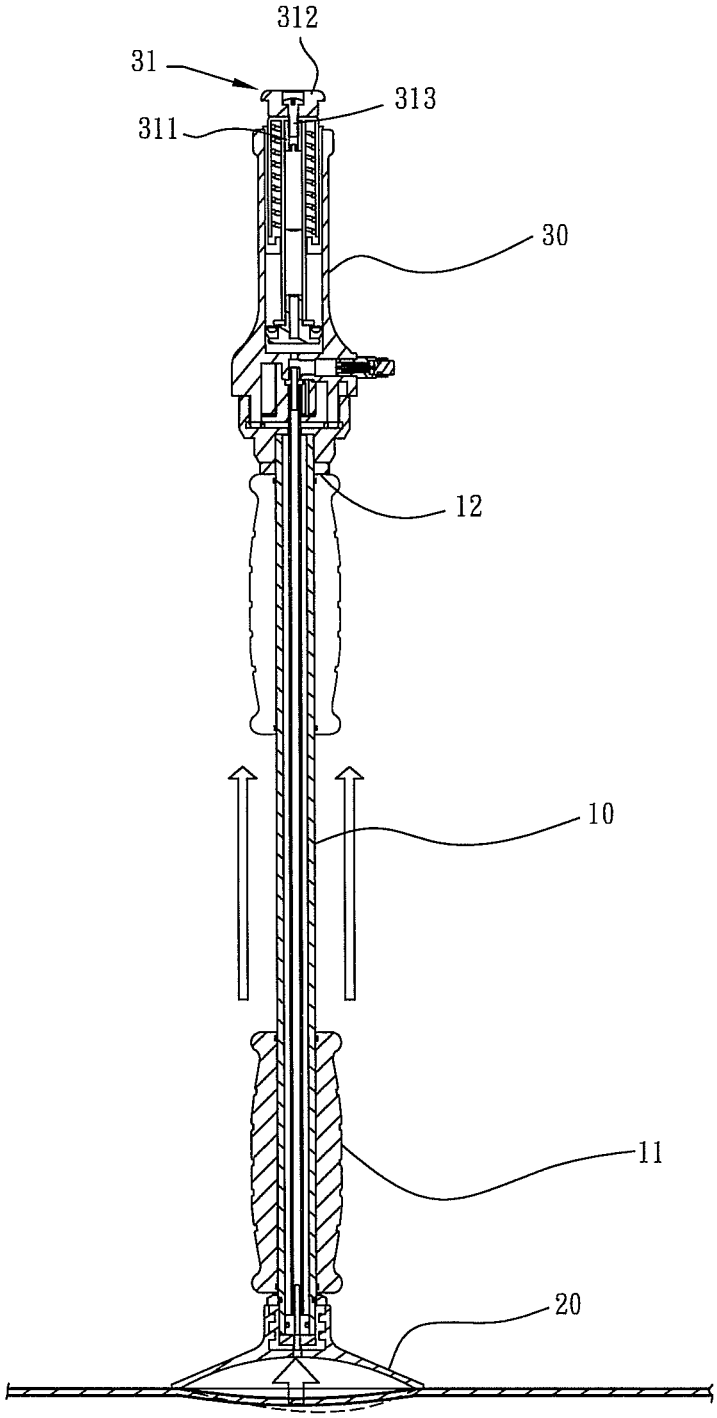
FIG. 6 is a cross-sectional view illustrating operation of a backward ram of the hand-operated vacuum pulling device according to the present invention.

As shown in FIGS. 4, 5, and 6, the interior space of the handgrip (namely the pump cylinder) where the piston assembly 32 is movable to induce vacuum is in communication with an interior space of the suction cup 20 where the suction force is induced through the tube 13. Thus, when the depression stem 321 of the piston assembly 32 of the hand-operated pump handgrip 30 is increasingly depressed, air contained in the interior space of the suction cup 20 is increasingly evacuated (through being expelled outside the pump cylinder) to form a vacuum suction force, and at the same time, the piston assembly 32 is continuously forced to move in a direction toward the suction cup 20 until it is no longer possible to access and hold the depression stem 321. Under this condition, the ring member 312 of the ring-shaped cover assembly 31 can be used by a user to pull the piston assembly 32 backward. The operation can be repeated several times to make the spring 33 contained in the piston assembly 32 getting stiffer and increase the vacuum suction force of the suction cup 20.

Once a sufficient suction force achieves for the suction cup 20, the backward ram 11 can be instantaneously moved toward the ram stop section 12 at the front end of the pressure relief seat 4 to generate an impact thereon so that a backward impact force is applied to the ram stop section, as illustrated in FIG. 6, which provides a backward pulling effect on the elongate shank 10 and the suction cup 20, thereby driving the suction cup 20 backward to pull and thus flatten an undesired recess or dent of car metal sheet. In this way, the dent can be repaired without removing internal parts or devices of the car. Further, the hand-operated vacuum pulling device according to the present invention may also be used as a device to remove or pull off a wooden plate, a glass sheet of a can, or a tile.

In summary, the present invention provides the following advantages:

(1) The present invention provides a novel structure of a hand-operated vacuum pulling device, which provides the same effect of pulling as a known pneumatic puller, and which comprises a relief button that allows of ready removal of the suction force of a suction cup through a simple depression of the button.

(2) The unique novel and improved structure of the hand-operated vacuum pulling device according to the present invention comprises a ring-shaped cover assembly, which, when a piston assembly is excessively drawn into a pump cylinder, provides a means for hand gripping in order to allow subsequent pulling and pushing operations to be performed to make a spring contained in the piston assembly stiffer and to enhance suction power, and as a consequence of such arrangement, the hand-operated vacuum pulling device provides the same suction effect as a pneumatic puller. Further, the additionally provided relief button allows of ready removal of the suction force.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A hand-operated vacuum pulling device, comprising:

an elongate shank, over which a backward ram is slidably fit;

a suction cup, which is coupled to a front end of the elongate shank; and a handgrip, which is coupled to a rear end of the elongate shank and comprises a pressure relief seat and a piston assembly movably received in a cylinder formed in the handgrip, a tube being received in and extending through the elongate shank and connecting between and in communication with the cylinder of the handgrip and the suction cup, the pressure relief seat forming a ram stop section at a joint with the shank, the handgrip having a rear end to which a ring-shaped cover assembly is attached, whereby the piston assembly is operated to induce a vacuum inside the cylinder, and the ring-shaped cover assembly is subsequently usable to pull the piston assembly backward for further operation in order to make a spring contained inside the piston assembly stiffer and increase a suction force of the suction cup, the backward ram being selectively movable backward to induce a backward impact for enhancing pulling effect.

2. The hand-operated vacuum pulling device as claimed in claim 1, wherein the ring-shaped cover assembly comprises a mounting sleeve, a ring member, and a locking member, the ring member being positionable on a depression stem of the piston assembly, the locking member securing the ring member to the mounting sleeve that is retained in the depression stem.

3. The hand-operated vacuum pulling device as claimed in claim 2, wherein the pressure relief seat has a side wall in which a pressure relief valve is mounted, the pressure relief valve comprising a relief button, which, once depressed, causes an elastic element to push away a plug, allowing air to flow through the relief button into the tube and the suction cup to removal the suction force.

* * * * *